US008601662B1

(12) United States Patent
Rankin

(10) Patent No.: US 8,601,662 B1
(45) Date of Patent: Dec. 10, 2013

(54) BIT PULLER

(71) Applicant: Hollis Edwin Rankin, Dilliner, PA (US)

(72) Inventor: Hollis Edwin Rankin, Dilliner, PA (US)

( * ) Notice: Subject to any disclaimer, the term of this patent is extended or adjusted under 35 U.S.C. 154(b) by 0 days.

(21) Appl. No.: 13/735,015

(22) Filed: Jan. 6, 2013

(51) Int. Cl.
*B23P 19/04* (2006.01)

(52) U.S. Cl.
USPC ..... 29/263; 29/270; 29/278; 29/255

(58) Field of Classification Search
USPC ..... 29/263, 255, 244, 270, 278, 252, 280
See application file for complete search history.

(56) References Cited

U.S. PATENT DOCUMENTS

| | | | | |
|---|---|---|---|---|
| 2,503,426 | A * | 4/1950 | Tower | 29/283 |
| 3,752,515 | A | 8/1973 | Oaks et al. | |
| 5,875,534 | A * | 3/1999 | Jackson | 29/255 |
| 6,478,383 | B1 | 11/2002 | Ojanen et al. | |
| 6,526,641 | B1 * | 3/2003 | Latham | 29/239 |
| 6,851,758 | B2 | 2/2005 | Beach | |
| 7,496,999 | B2 * | 3/2009 | Robarge | 29/265 |
| 7,658,368 | B2 * | 2/2010 | Laun | 254/18 |
| 8,256,081 | B2 * | 9/2012 | Fridman | 29/255 |
| 2009/0236572 | A1 * | 9/2009 | Laun | 254/18 |

* cited by examiner

*Primary Examiner* — Lee D Wilson
(74) *Attorney, Agent, or Firm* — Bradley M. Voorhees

(57) ABSTRACT

A bit extracting tool, used to pull rotatable cutting bits from bit pocket holders. The bit extractor tool comprises two concentric pipe sleeves: an inner tension sleeve with fingers to slide over and hook the rotatable cutting bit's exposed annular ring at the bit end, and a threaded hole at the pulling end which receives the tension bolt; a tension bolt which, when tightened, pulls the tension sleeve away from the pocket and pushes on the capped pulling end of the outer compression sleeve; and, a compression sleeve, open on the bit end which pushes on the face of the pocket holder surface, is capped on the pulling end to bear the force of the tension bolt as it pulls the inner sleeve, and locks the finger hooks into the annular bit ring, which tow the bit out of the bit pocket.

11 Claims, 7 Drawing Sheets

Typical Cutting Bit (Bullet Bit)

Typical Pocket Holder (Pocket)

Pocket Holder Cross-Section

Seated Bit in Pocket Holder
Cross Section

BIT PULLER

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

This invention is directed toward the maintenance of rotating cutting tool assemblies that use bullet shaped cutting bits, typically seated in pocket holders which are affixed to the surface of a rotating member, such as an auger or other drill head apparatus. This tool extracts the rotatable cutting bits from the bit pockets.

Bullet bits are the teeth of these rotating cutting assemblies and wear out at different rates depending on the particular substrate being cut. These bullet bits wear and must be replaced to avoid uneven cutting, vibrations, damage to the pockets, and damage to the other components of the auger assembly.

These seated bullet cutting bits have an exposed annular groove near the surface of the bit pocket, the pocket holds the bullet bit at an angle to the surface of the auger head, and the pocket has an open back such that the shank of the bullet bit is visible from the back of the pocket holder.

U.S. Pat. No. 3,752,515, and U.S. Pat. No. 6,851,758, disclose a solution to the problem of bit retaining, and the mechanism for keeping the bullet bit seated in the pocket while allowing it to rotate, via a collar which is wrapped around the shank of the cutting bit, and engages an internal annular ring within the pocket holder. Heretofore, the art, such as U.S. Pat. No. 6,478,383, has focused almost exclusively on bit pocket design and retainer methods rather than safe bit extraction tools. Removing these bullet bits is currently performed by either punching the back of the shank through the open back of the pocket holder, ejecting the bullet bit, or by sliding a two pronged fork (referred to as a 'crow's foot') across the bits' external annular groove, at the surface of the pocket, and prying the bit out of the pocket.

Consistent with this articulation of the state of the art in bit extraction, is the recital in paragraph nine of the Background of the Invention section of, U.S. Pat. No. 6,851,758; the state of the art in bit extraction is dynamic punching. Currently drillers hammer-punch the bit out from the back of the pocket holder, or pry the bit out with a "crow's foot" fork ended pry bar, when the back of the pocket is not accessible. These are the only two means for bit extraction until now. These dynamic, awkward, and often unsafe methods are often ineffective leading to many hours of lost productivity, equipment damage, and often operator injury.

Depending on the size of the auger head, and the pocket holder arrangement, some bits cannot be punched out because the back of the pocket holder is not easily accessible. Often the angle of the bit, and the difficulty in prying the bit out, leads to hours of lost productivity, injuries resulting from mishaps with hammers, forks, and punches, and when operators cannot remove the bit, they often continue to drill with unevenly worn bits, which can seriously damage the drilling rig and lead to other injuries and equipment damage.

(1) FIELD OF THE INVENTION

The field of the invention is rotating cutting assembly (boring) maintenance and repair (tools), specifically removal of bullet cutting bits, typically seated in pocket holders, which are affixed to auger heads commonly used in mining and other substrate drilling.

(2) DESCRIPTION OF RELATED ART

References

U.S. Pat. No. 2,503,426 April 1950. Tower, Miles E.
U.S. Pat. No. 3,752,515 August 1973 Oaks, et. al.
U.S. Pat. No. 5,875,534 March 1999 Jackson, Benjamin C.
U.S. Pat. No. 6,478,383 November 2002 Oanjen, et al.
U.S. Pat. No. 6,851,758 December 2002 Beach
U.S. Pat. No. 6,526,641 March 2003 Latham, Winchester E.
U.S. Pat. No. 7,496,999 March 2009 Robarge, Randall P.
U.S. Pat. No. 7,658,368 February 2010 Laun, Craig M.
U.S. Pat. No. 8,256,081 September 2012 Fridman, Gideon

BRIEF SUMMARY OF THE INVENTION

This invention is a tool assembly that uses a compression cylinder, a tension cylinder and a tension bolt, to engage the exposed annular ring of a rotatable cutting bit and the surface of the bit pocket holder to directly extract the bit from the pocket without dynamic punching or prying.

In one form, the invention is a tool assembly useful for pulling cutting bits, or bullet bits, from their pockets, which are typically fixed to drill assemblies. The tool assembly comprises two concentric cylinders, where the bit end of the inner cylinder is split into fingered hooks and slides over the seated bullet bit such that the finger hooks seat in the annular groove near the base of the exposed bit. The opposite pulling end of the inner cylinder is closed, and bears a threaded hole to receive a threaded bolt that, when tightened, draws the tension cylinder, and the hooked bullet bit, out of the bit holder. The invention is inexpensive to manufacture can be easily machined and cut from commonly available materials; the tension cylinder can be manufactured from a common carbon steel pipe of the same nominal diameter as the diameter of the bit intended for extraction, with the compression cylinder a nominal diameter of the inner cylinder plus twice the thickness of the tension cylinder pipe.

In another form, the invention is a tool assembly useful for pulling cutting bits, or bullet bits, from their pockets, which are typically fixed to drill assemblies. The tool assembly comprises two concentric cylinders, where the bit end of the inner cylinder is split into fingered hooks and slides over the seated bullet bit such that the finger hooks seat in the exposed annular groove of the bit near the base of the exposed bit. The opposite pulling end of the inner cylinder is closed, and bears a threaded hole to receive a threaded bolt that, when tightened, draws the tension cylinder, and the hooked bullet bit, away from the bit holder. This will enable workmen to pull any size bit much faster and more reliably which will yield more drilling productivity. It will also improve rig maintenance because drillers will not be forced to continue to drill with worn cutting bits if damaged bits cannot be punched or pried out.

In another form, the invention is a tool assembly useful for pulling cutting bits, or bullet bits, from their pockets, which are typically fixed to drill assemblies. The tool assembly comprises an inner tension cylinder which hooks the bullet bit and through a tension bolt, where said bolt pulls against a capped, concentric compression cylinder, which creates a focused axial force that pulls the bullet bit parallel to the bit shank centerline and straight out of the holder, minimizing mechanical and friction resistance against the effort.

In another form, the invention is a tool assembly useful for pulling cutting bits, or bullet bits, from their pockets, which are typically fixed to drill assemblies. The tool assembly comprises two concentric cylinders, where the bit end of the inner cylinder is split into fingered hooks and slides over the seated bullet bit such that the finger hooks seat in the exposed annular groove of the bit near the base of the exposed bit. The opposite pulling end of the inner cylinder is closed, and bears a threaded hole to receive a threaded bolt that, when tightened, draws the tension cylinder, and the hooked bullet bit, away from the bit holder. This pulling device eliminates the need to arrange bit pocket holders on the auger assembly in a configuration that permits access to the back of the pocket holder for the purpose of bit extraction. In other words, this invention allows drillers to attach bits to the drill in a configuration and number with only their cutting effectiveness in mind.

In another form, the invention is a tool assembly useful for pulling cutting bits, or bullet bits, from their pockets, which are typically fixed to drill assemblies. The tool assembly comprises two concentric cylinders, where the bit end of the inner cylinder is split into fingered hooks and slides over the seated bullet bit such that the finger hooks seat in the annular groove near the base of the exposed bit. The opposite pulling end of the inner cylinder is closed, and bears a threaded hole to receive a threaded bolt that, when tightened, draws the tension cylinder, and the hooked bullet bit, away from the bit holder. This method is a safe, non-dynamic leverage tool to remove any size bit faster, safer, and avoid unsafe dynamic difficult to control conditions during drill maintenance, and prevents common injuries routinely suffered by drill workers.

BRIEF DESCRIPTION OF THE SEVERAL VIEWS OF THE DRAWING(S)

DETAILED DESCRIPTION OF THE INVENTION

(1) Summary of Invention and Advantages

Figure 1:
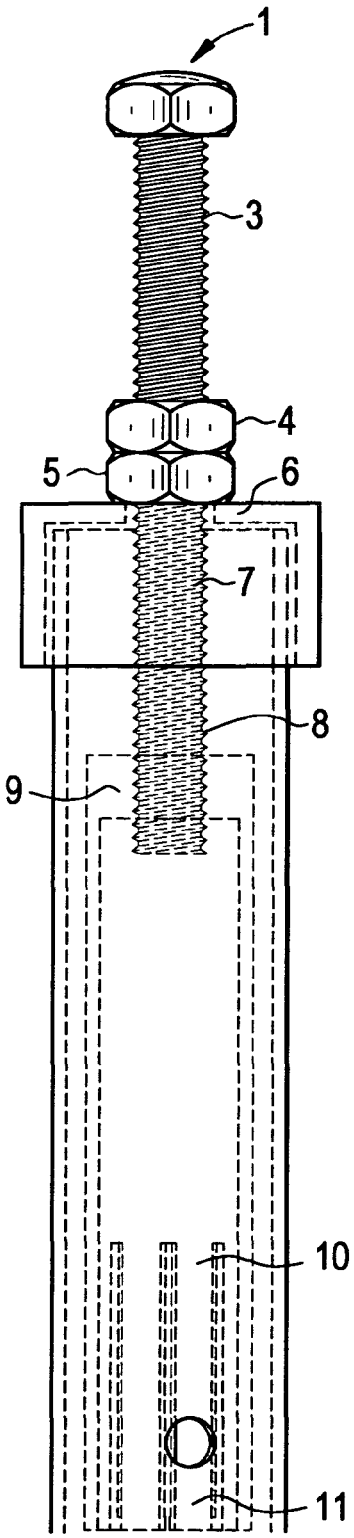
FIG. 1 is a side view of the assembled bit extraction tool which is the subject of the patent application.
Figure 2:
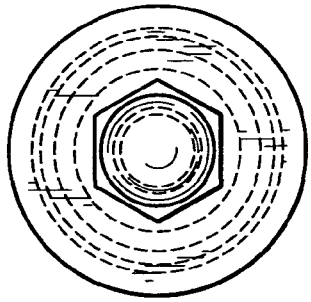
FIG. 2 is a top view of the assembled bit extraction tool which is the subject of the patent application.
Figure 3:
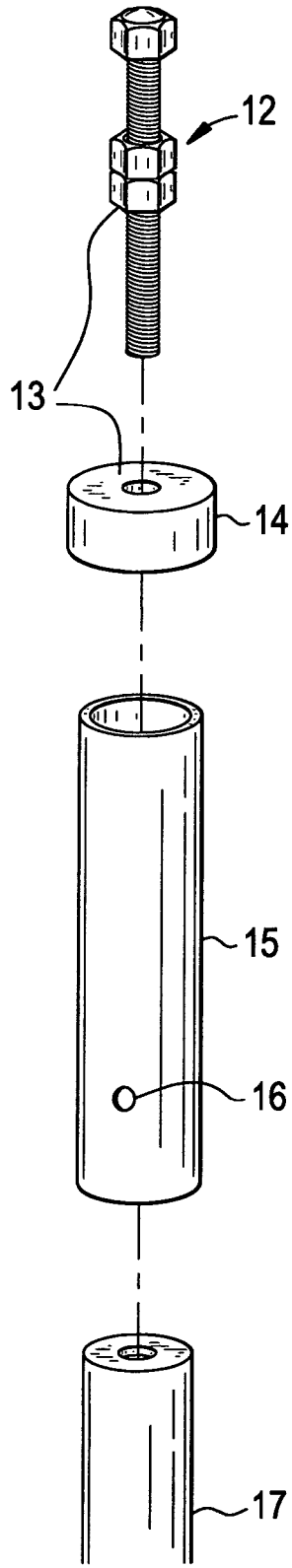
FIG. 3 is an exploded view of the components of the bit extraction tool which is the subject of the application.

In one form, the invention is a tool assembly useful for pulling cutting bits, or bullet bits, from their pockets, or holders, which are typically fixed to drill assemblies. The tool assembly comprises two concentric cylinders, where the bit end of the inner cylinder is split into fingered hooks and slides over the seated bullet bit such that the finger hooks seat in the annular groove near the base of the exposed bit. The opposite pulling end of the inner cylinder is closed, and bears a threaded hole to receive a threaded bolt that, when tightened, draws the tension cylinder, and the hooked bullet bit, out of the bit holder. The invention is inexpensive to manufacture can be easily machined and cut from commonly available materials; the tension cylinder can be manufactured from a common carbon steel pipe of the same nominal diameter as the diameter of the bit intended for extraction, with the compression cylinder a nominal diameter of the inner cylinder plus twice the thickness of the tension cylinder pipe.

In another form, the invention is a tool assembly useful for pulling cutting bits, or bullet bits, from their pockets, or holders, which are typically fixed to drill assemblies. The tool assembly comprises two concentric cylinders, where the bit end of the inner cylinder is split into fingered hooks and slides over the seated bullet bit such that the finger hooks seat in the exposed annular groove of the bit near the base of the exposed bit. The opposite pulling end of the inner cylinder is closed, and bears a threaded hole to receive a threaded bolt that, when tightened, draws the tension cylinder, and the hooked bullet bit, away from the bit holder. This will enable workmen to pull any size bit much faster and more reliably which will yield more drilling productivity. It will also improve rig maintenance because drillers will not be forced to continue to drill with worn cutting bits if damaged bits cannot be punched or pried out.

In another form, the invention is a tool assembly useful for pulling cutting bits, or bullet bits, from their pockets, or holders, which are typically fixed to drill assemblies. The tool assembly comprises an inner tension cylinder which hooks the bullet bit and through a tension bolt, where said bolt pulls against a capped, concentric compression cylinder, which creates a focused axial force that pulls the bullet bit parallel to the bit shank centerline and straight out of the holder, minimizing mechanical and friction resistance against the effort.

In another form, the invention is a tool assembly useful for pulling cutting bits, or bullet bits, from their pockets, or holders, which are typically fixed to drill assemblies. The tool assembly comprises two concentric cylinders, where the bit end of the inner cylinder is split into fingered hooks and slides over the seated bullet bit such that the finger hooks seat in the exposed annular groove of the bit near the base of the exposed bit. The opposite pulling end of the inner cylinder is closed, and bears a threaded hole to receive a threaded bolt that, when tightened, draws the tension cylinder, and the hooked bullet bit, away from the bit holder. This pulling device eliminates the need to arrange bit pocket holders on the auger assembly in a configuration that permits access to the back of the pocket holder for the purpose of bit extraction. In other words, this invention allows drillers to attach bits to the drill in a configuration and number with only their cutting effectiveness in mind.

In another form, the invention is a tool assembly useful for pulling cutting bits, or bullet bits, from their pockets, or holders, which are typically fixed to drill assemblies. The tool assembly comprises two concentric cylinders, where the bit end of the inner cylinder is split into fingered hooks and slides over the seated bullet bit such that the finger hooks seat in the annular groove near the base of the exposed bit. The opposite pulling end of the inner cylinder is closed, and bears a threaded hole to receive a threaded bolt that, when tightened, draws the tension cylinder, and the hooked bullet bit, away from the bit holder. This method is a safe, non-dynamic leverage tool to remove any size bit faster, safer, and avoid unsafe dynamic difficult to control conditions during drill maintenance, and prevents common injuries routinely suffered by drill workers.

(2) Description of Preferred Embodiments

Figure 4:
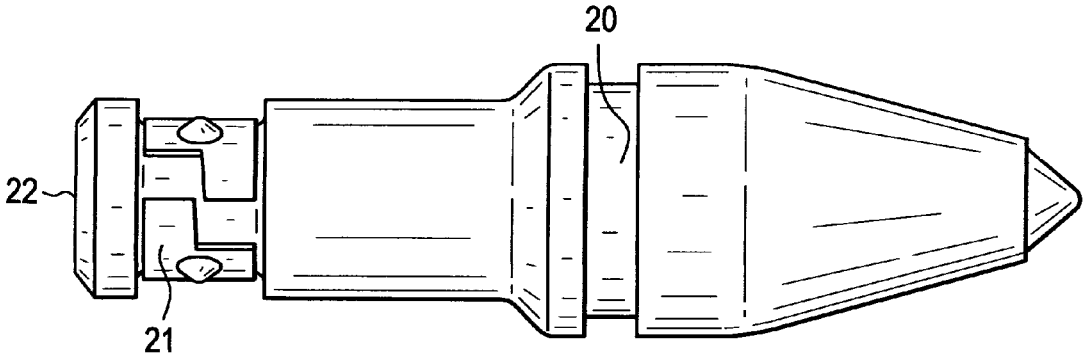
FIG. 4 PRIOR ART
FIG. 4 is a side view of a typical bullet bit. (Prior Art).
Figure 5A:
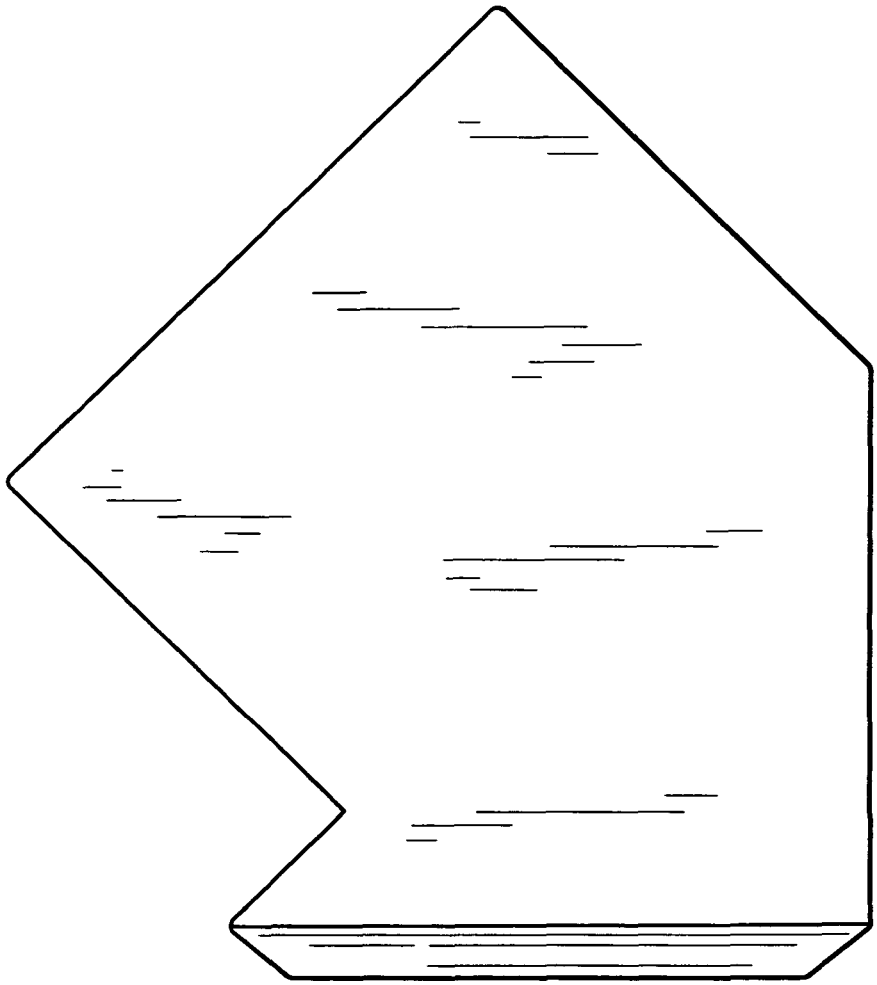
FIG. 5A PRIOR ART
FIG. 5A is a side view of a typical bit pocket holder; 5B is a cross section view of a typical bit pocket holder; and, 5C is a cross section view of a bullet bit seated in a typical bit pocket holder. (Prior Art).
Figure 5B:
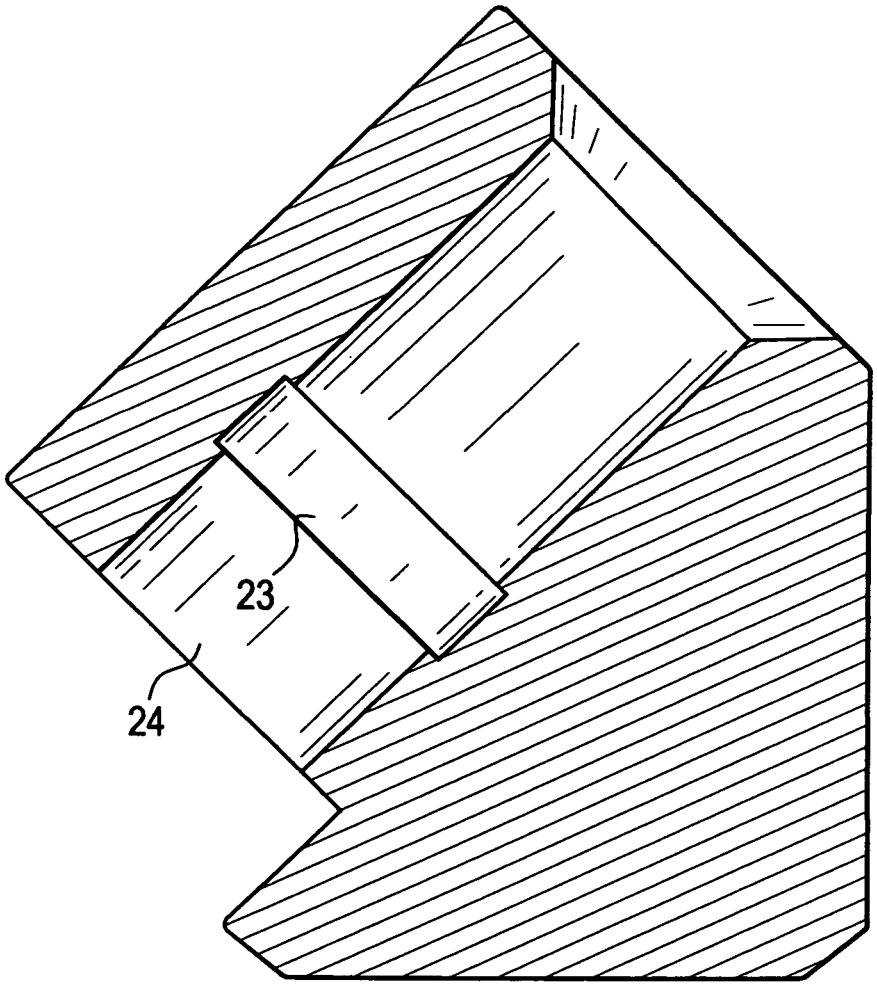
FIG. 5B PRIOR ART
Figure 5C:
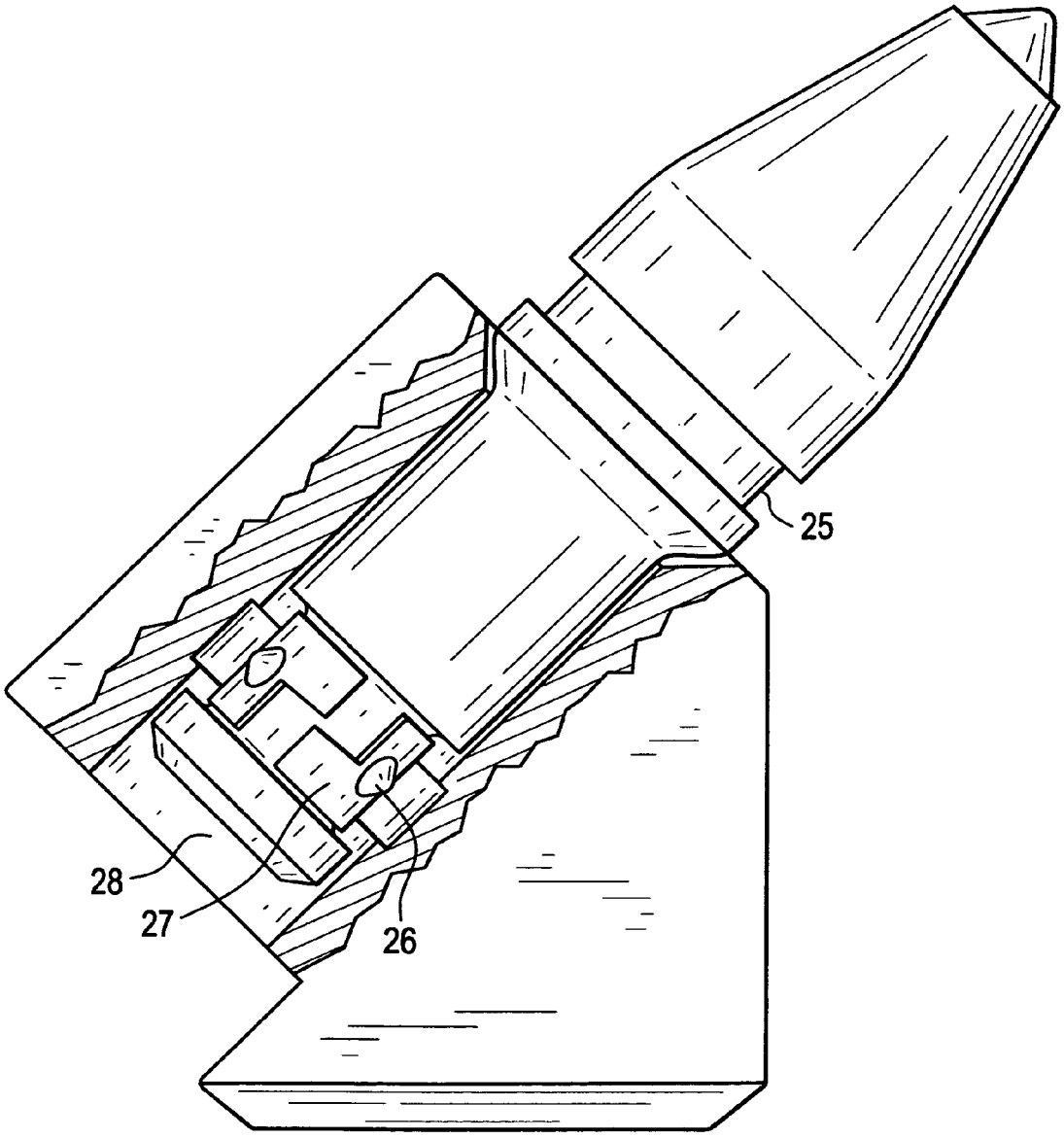
FIG. 5C PRIOR ART

The Bit Puller tension cylinder 17, designed to extract the typical 1.25" diameter bullet bit FIG. 4, should be manufactured from Schedule 40, turned down to 0.125" wall thickness, of the same nominal diameter carbon steel pipe as the diameter of the bullet bit at its widest point (1.25"). The compression cylinder 15 should be manufactured from Schedule 40 carbon steel pipe of a nominal diameter 0.25" larger than the tension cylinder's nominal diameter (1.5"). Larger and smaller scale bit pullers should size the tension cylinder according to the largest diameter of the target bit, while the compression cylinder should be a nominal diameter equal to that of the tension cylinder plus twice the wall thickness of the tension cylinder pipe 42. The tension cylinder 17 should be sized 5" taller than the height of the exposed target bit FIG. 5*c*, measured from the pocket surface 43 and the compression cylinder 15 should be at least three inches taller than the tension cylinder 17.

The compression cylinder cap 14 should be at least 0.25" thick 6 and bear no threads 19.

The interior hooks 11 of the tension cylinder 17 are created with 0.25" weld bead around the interior of the tension cylinder's bit end, which is then machined down to a 0.1875" interior protrusion with a 0.125" height. These dimensions permit the hooks to engage the annular ring of the bullet bit 38 at the surface of the pocket 25.

The fingers of the tension cylinder 10 are created by slicing the bit end of the tension cylinder at least 8 times, parallel to the longitudinal axis of the tension cylinder, evenly spaced across the circumference of the tension cylinder 17, where said cuts are between 3" and 4" long. Cuts shorter than three inches might not permit enough flexibility in the fingers to facilitate hand removal of the bullet bit from the hooks after extraction FIG. 6.

The all-thread tension bolt 3 should be Grade 1 or higher carbon steel. The bolt diameter should be at least four times the thickness of the compression cylinder wall 8. In the standard puller, designed to extract a target bit of 1.25", a 0.625" diameter bolt is best. The tension bolt should leave between 3" and 6" of space between the hex head 1 on the pulling end, and the tension bolt bearing surface 13, as a handle for the operator to draw the tension cylinder through the compression cylinder to remove the extracted bullet bit from the finger hooks after the tool extracts the bullet bit from the pocket.

The two 0.625" standard, jam-nut 12 bearing surface, is adjustable, and should be set such that the bolt is long enough below the bearing surface to completely thread through the tension cylinder 34 without protruding more than 1" into the interior of the tension cylinder 35.

Figure 6:
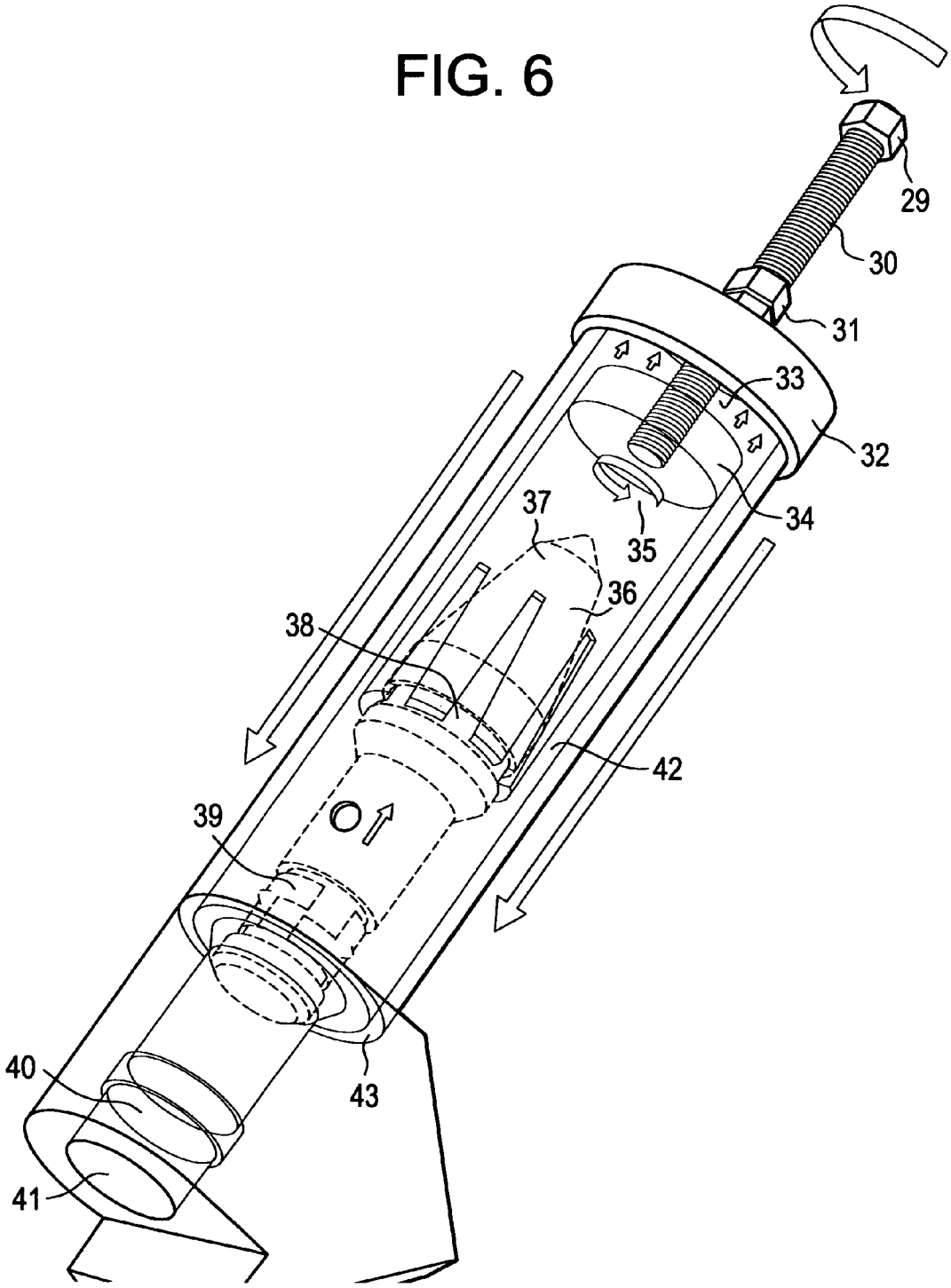
FIG. 6 is an isometric force diagram of the bit extraction tool as it extracts a typical bullet bit from a typical bit pocket holder.

The closed, threaded pulling end of the tension cylinder 34 should be at least as thick as the tension bolt 30; in the exemplar tool, designed to extract 1.25" bullet bits, the tension cylinder's closed pulling end 34 should be 0.75" thick with a threaded 0.625" center hole 18 to receive the tension bolt. The tension bolt also has a bolt 29 attached as a head and bolts 31 which produce threaded aperture with a second bolt which acts as locking bolt as shown in FIG. 6. FIG. 6 shows a porthole which is shown on the compression cylinder being the outer cylinder. The compression cylinder bears a non-concentric porthole near the bit end to provide access to the finger hooks of the tension cylinder to prevent internal rotation of the tension cylinder during operation.

It may be appreciated that various changes to the details of the illustrated embodiments and systems disclosed herein, may be made without departing from the spirit of the invention. While preferred and alternative embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

I claim:

1. A tool assembly for extraction a bit said tool comprising: an outer compression cylinder, a compression cylinder cap, a concentric inner tension cylinder having a plurality of slots and hooks, and a tension bolt which passes through the unthreaded hole of, and bears against, the compression cylinder cap, and threads into the threaded end of the tension cylinder such that when the tension bolt is tightened, said tension bolt draws the tension cylinder toward the cap of the outer compression cylinder.

2. The tool assembly as set forth in claim 1, wherein the inner tension cylinder is closed with a threaded hole at the pulling end, and the hooks having a finger shape at the bit end, such that the tension cylinder can slide over a seated bullet bit and hook the bullet bit, by the exposed annular ring of said bullet bit, with said finger shape hooks.

3. The tool assembly as set forth in claim 1, wherein the hooks having a finger shape are at the bit end of the tension cylinder are 4" long and the hooks extend 0.1875" inward.

4. The tool assembly as set forth in claim 1, wherein the outer compression cylinder is capped with an unthreaded hole in the cap at the pulling end, and open at the bit end such that the compression cylinder can slide over the tension sleeve and seat against the face of the pocket surface around the bit pocket.

5. The tool assembly as set forth in claim 1, wherein the outer compression cylinder bears a small observation hole between 1" and 3" from the open bit end to ensure the tension cylinder does not rotate inside the compression cylinder during extraction.

6. The tool assembly as set forth in claim 1, wherein the compression cylinder cap further comprises a thickness.

7. The tool assembly as set forth in claim 1, wherein the tension bolt having a hex head at the pulling end and a tension bolt bearing surface 5" from the threaded end, bears against the top of compression cylinder cap to transfer the load to the compression cylinder as the tension bolt tightens.

8. The tool assembly as set forth in claim 1, wherein the tension bolt includes a plurality of threaded fasteners with at least one of said fasteners being a head and one acting as a locking bolt.

9. The tool assembly as set forth in claim 1, wherein the compression cylinder bears a non-concentric porthole near the bit end to provide access to the finger hooks of the tension cylinder to prevent internal rotation of the tension cylinder during operation.

10. A tool assembly for extraction a bit said tool comprising: an outer compression cylinder, a compression cylinder cap, a concentric inner tension cylinder having a plurality of slots and hooks, and a tension bolt which passes through the unthreaded hole of, and bears against, the compression cylinder cap, and threads into the threaded end of the tension cylinder such that when the tension bolt is tightened, said tension bolt draws the tension cylinder toward the cap of the outer compression cylinder wherein the tension bolt includes a plurality of threaded fasteners with at least one of said fasteners being a head and one acting as a locking bolt.

11. A tool assembly for extraction a bit said tool comprising: an outer compression cylinder includes a porthole, a compression cylinder cap, a concentric inner tension cylinder having a plurality of slots and hooks, and a tension bolt which passes through the unthreaded hole of, and bears against, the compression cylinder cap, and threads into the threaded end of the tension cylinder such that when the tension bolt is tightened, said tension bolt draws the tension cylinder toward the cap of the outer compression cylinder.

* * * * *